United States Patent [19]

Boone

[11] Patent Number: 4,691,388

[45] Date of Patent: Sep. 8, 1987

[54] GOLF GLOVE

[75] Inventor: David D. Boone, Oceanside, Calif.

[73] Assignee: Lynx Golf, Inc., City of Industry, Calif.

[21] Appl. No.: 853,691

[22] Filed: Apr. 18, 1986

[51] Int. Cl.[4] ..... A41D 19/00

[52] U.S. Cl. ..... 2/161 A; 2/159

[58] Field of Search ..... 2/161 A, 159, 161 R, 2/167, 162

[56] References Cited

U.S. PATENT DOCUMENTS

| | | | |
|---|---|---|---|
| 2,113,731 | 4/1938 | Kennedy | 2/162 |
| 2,258,999 | 10/1941 | Nunn | 2/161 A |
| 2,700,159 | 1/1955 | Van Den Burgh | 2/161 A |
| 3,255,462 | 6/1966 | Antonious | 2/161 A |
| 3,504,379 | 4/1970 | Glick | 2/161 A |
| 3,588,917 | 6/1971 | Antonious | 2/161 A |
| 3,952,333 | 4/1976 | Fujita | 2/161 A |
| 3,997,922 | 12/1976 | Huhta | 2/161 A |
| 4,000,903 | 1/1977 | Swanson | 2/161 A |
| 4,042,977 | 8/1977 | Antonious | 2/161 A |
| 4,057,255 | 11/1977 | Bishop | 2/161 A |

*Primary Examiner*—Werner H. Schroeder
*Assistant Examiner*—Mary A. Ellis
*Attorney, Agent, or Firm*—Leonard Tachner

[57] ABSTRACT

A sport glove especially advantageous to golfers employs a diagonally-shaped opening for convenience of repeatedly placing the glove on the hand and removing it, a diagonally-shaped fastening means and a plurality of diagonally positioned elastic means sewn into the glove material on both the palm-side and knuckle-side of the glove to generate diagonally directed tension forces through the palm of the glove to improve the fit and performance of the glove during play.

4 Claims, 4 Drawing Figures

GOLF GLOVE

BACKGROUND OF THE INVENTION

1. Field of the Invention

The present invention relates generally to sport gloves and more specifically to an improved sport glove that is especially advantageous for use by golfers.

2. Prior Art

Although the present invention is useable by race-car drivers, baseball players, racketball players, and other sports participants, it is particularly designed for the golfer who needs a soft, flexible glove to feel the club, a glove easy to put on and take off repeatedly and a glove which protects the golfer's hand. The glove of the present invention is particularly advantageous when used by golfers on the hand which grips the club highest on the shaft for gripping the club handle while minimizing the possibilities for slippage such as might occur as a result of perspiration on the hand and while also avoiding injury to the hand such as blistering and the like from repeated usage.

One significant problem of prior art gloves that is particularly important to golfers is the tendency for such gloves to permit the glove material in the palm area to move, ride or lift up and thereby interfere with the grasp of the golf club handle. Prior art golf glove designers have recognized that the solution to this particular problem can be provided in a golf glove that provides the wearer with a taut fit. However, such a taut fit must also be configured to accommodate repeated removal and reinsertion of the hand from the glove to accommodate most golfer's predelection for not wearing the glove continuously from the beginning of play to the end of play.

Accordingly, a suitable golf glove which provides a taut fit must also provide means for allowing the hand to enter and fit easily into the glove with a minimum of inconvenience to the user in resecuring the glove to the hand. In this regard a large number of patents have issued disclosing gloves that are intended to provide the aforementioned desirable characteristics ot taut fit and convenience of hand insertion and fastening.

By way of example, U.S. Reissue Pat. No. RE 31,538 which issued on Mar. 20, 1984 and was based on prior U.S. Pat. No. 3,588,917 issued on June 29, 1971, listed 84 prior art patents relevant to the golf glove specifically disclosed in the reissue patent. Unfortunately, all such prior art attempts including the golf club disclosed in the aforementioned reissue patent, failed to provide a golf glove which optimally combines the requirement for a taut fit with convenience of easy hand insertion and simple attachment.

By way of example, the golf glove disclosed in aforementioned U.S. Reissue Pat. No. RE 31,538 discloses the use of elastic sewn into the knuckle area of glove with the elastic directed substantially perpendicular to the user's arm and lying adjacent to and in front of a relatively complex fastening device which detracts from the convenience of use and attachment. Furthermore, the provision of relatively straight elastic material on only the knuckle-side of the glove still does not satisfactorily solve the requirement for a taut fit, particularly in the palm area of the glove where there remains a likelehood of the glove material moving, riding or lifting up to interfere with the use of the glove and detract from satisfying the principal functional objective of the glove.

SUMMARY OF THE INVENTION

The present invention comprises a novel glove construction which more satisfactorily addresses the aforementioned problems of the prior art. More specifically, the present invention combines a plurality of unique features, the combination of which significantly enhances the taut fit and convenience of use of the present invention as compared to the prior art. These features comprise a diagonal opening, a diagonal Velcro closure, a diagonal elastic means across the knuckle-side of the glove located between the base or wrist portion of the glove and the Velcro closure, and a diagonal elastic means across the base of the palm area of the glove.

The principal advantages of this novel combination of features are the significant improvement in the ease of placing the glove on the hand and removing it repeatedly and the redirection of the distribution of forces on the glove to assure a taut fit, particularly in the palm area where such fit is most critical. More specifically, in the present invention, the novel placement of elastic means in critical locations of the glove produces a diagonally-directed force in the surface of the glove in the palm area, which force significantly enhances the resistance of the glove to moving, riding, lifting up or bunching up of the glove material in the palm area.

OBJECTS OF THE INVENTION

It is therefore a principal object of the present invention to provide a novel sporting glove, the construction of which solves a long-felt need for a glove that remains taut on the wearer's hand and which is extremely easy and convenient to place on the wearer's hand and remove from the wearer's hand repeatedly throughout play.

It is an additional object of the present invention to provide an improved golf glove which comprises a unique diagonal opening to significantly increase the ease and convenience of placing the glove on the golfer's hand and removing it from the golfer's hand repeatedly throughout the golf game.

It is still an additional object of the present invention to provide an improved golf glove having uniquely located elastic means across the top of the glove between the base and a diagonal opening and across the bottom of the glove adjacent the base of the palm, each designed to redirect the forces in the palm area of the glove to be diagonal in direction for ensuring a taut fit in the palm area of the glove in particular.

It is still an additional object of the present invention to provide an improved golf glove, the design of which incorporates a diagonal opening used in conjunction with diagonal elastic tensioners to yield a fit superior to prior art glove designs as a result of a novel diagonal stretching force.

BRIEF DESCRIPTION OF THE DRAWINGS

The aforementioned objects and advantages of the present invention as well as additional objects and advantages thereof will be more fully understood hereinafter as a result of a detailed description of a preferred embodiment when taken in conjunction with the following drawings in which.

DETAILED DESCRIPTION OF A PREFERRED EMBODIMENT

Figure 1:
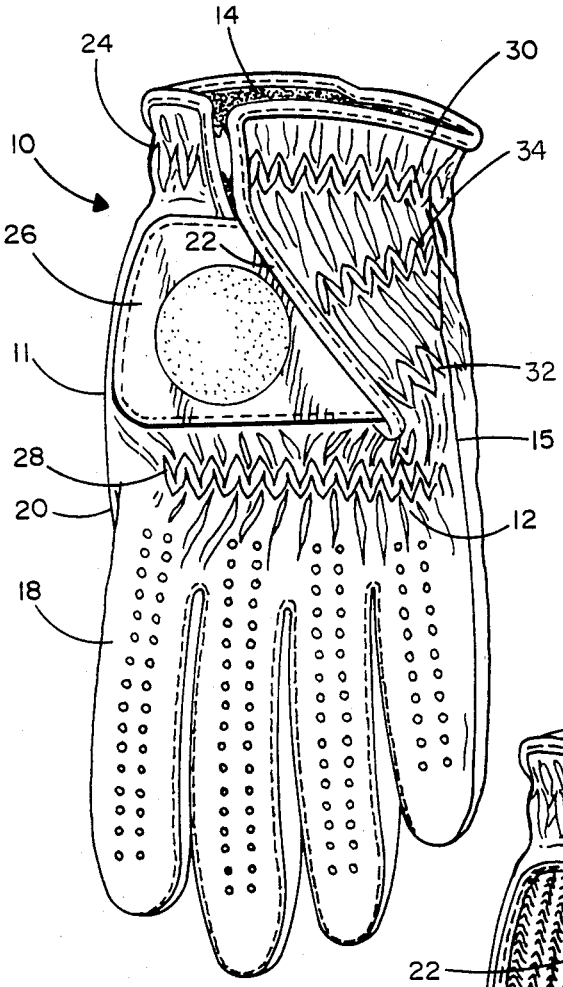
FIG. 1 is a knuckle-side view of glove of the present invention with the glove in its closed or secured configuration.
Figure 2:
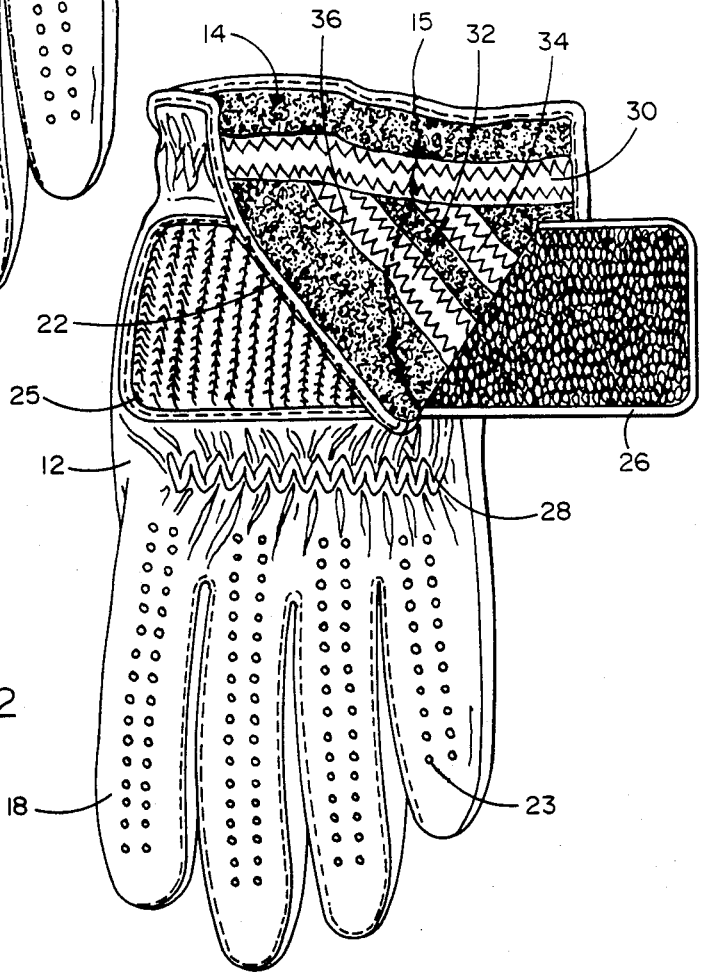
FIG. 2 is a knuckle-side view of the present invention with the glove opening in its unsecured and fully accessible configuration.
Figure 3:
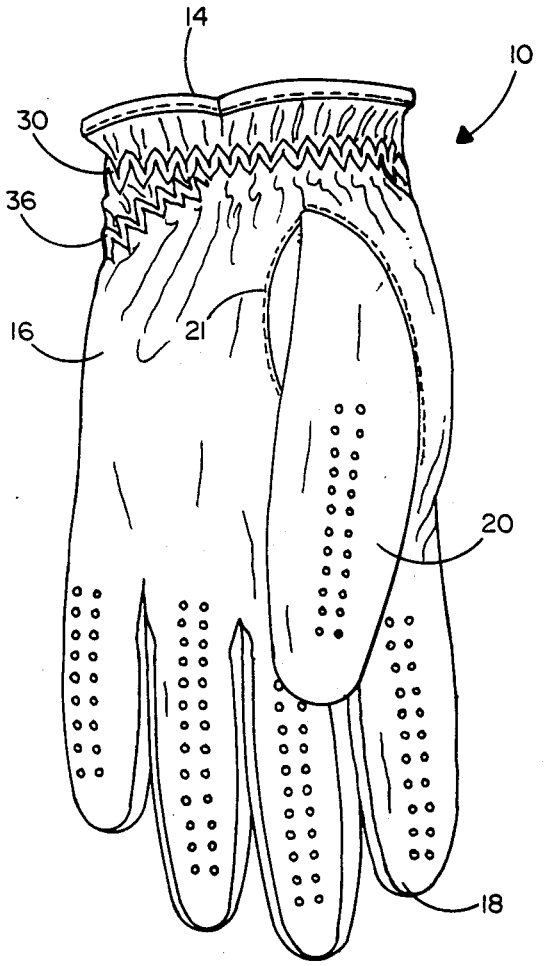
FIG. 3 is a palm-side view of the glove of the present invention.

Referring first to FIGS. 1, 2 and 3, it will be seen that the golf glove 10 of the present invention comprises a hollow, flexible body 11 formed of leather or other such soft, resilient material and having a top or knuckle portion 12 and a bottom or palm portion 16 joined along a major seam 15 and open at one end to form as access opening 14. Portions 12 and 16 are shaped to form four finger stalls 18. In additional, the bottom or palm portion 16 is provided with a thumb stall 20 which is sewn into the palm portion 16 along an aperture 21.

The bottom or palm portion 16 of the golf glove 10 is provided with a diagonal opening 22 which extends from the access opening 14 at the heel 24 of the glove across the top or knuckle portion 12 toward the finger stalls 18. As seen best in FIGS. 1 and 2, the diagonal opening 22 is provided with a pair of matching diagonally-shaped Velcro fastening members 25 and 26. It will be seen that the diagonal design of the opening 22 as well as of the Velcro fastening members 25 and 26, provide a very ample access for the user to place the glove 10 of the present invention on his hand with significant ease and convenience not heretofore available in the prior art known to the applicant.

The diagonal opening 22 cooperates with a plurality of elastic means, hereinafter described, to provide a second significant advantage to the present invention as compared to the prior art. More specifically, as seen in FIGS. 1, 2 and 3, the glove 10 of the present invention is provided with a knuckle area elastic means 28 and a wrist area elastic means 30, both of which find comparable analogous elements in the prior art.

However, in addition to these elastic means, the present invention also provides a first top portion diagonal elastic means 32 and a second top portion diagonal elastic means 34 both positioned on the top or knuckle portion 12 of the present invention between the diagonal opening 22 and the seam 15, wherein the axis of elastic means 32 and 34 run substantially perpendicular to the opening 22.

In addition, the bottom or palm portion 16 of the glove 10 is provided with a bottom portion diagonal elastic means 36 seen best in FIG. 3. Elastic means 36 runs between the wrist area elastic means 30 and the seam 15 and forms an extension of first top portion diagonal elastic means 32 on the other side of seam 15.

Figure 4:
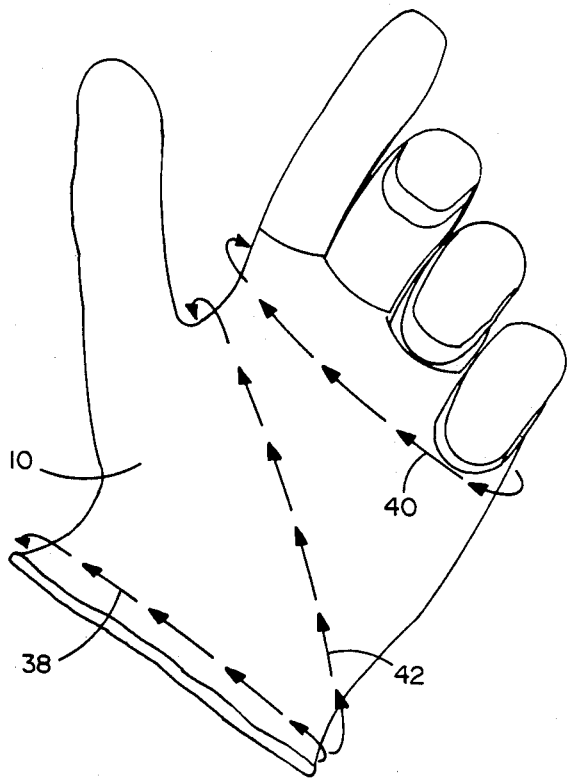
FIG. 4 is a schematic illustration of the glove shown on a wearer's hand and illustrating the redirection of forces obtained by means of the present invention.

The effects generated by the various elastic means of the present invention are illustrated in FIG. 4 wherein the glove 10 of the present invention is shown on a user's hand. As seen in FIG. 4, the conventional wrist area elastic means 30 sets up force lines 38 for securing the glove on the user's hand below the base portion of the palm adjacent the user's wrist. Furthermore, it will be seen that the knuckle area elastic means 28 seen in FIG. 1 establishes force lines 40 extending through the palm area of the glove adjacent the finger stalls 18 in a direction substantially transverse to the axis of the user's arm.

Those having skill in the art to which the present invention pertains will recognize that the force lines 38 and 40 established by conventional elastic means 28 and 30 find analogous tensioning forces in prior art disclosures such as aforementioned U.S. Reissue Pat. No. RE. 31,538. However, unlike the prior art known to the applicant, the interaction of elastic means 32, 34 and 36; diagonal opening 22; and Velcro fastening members 25 and 26, creates an additional set of force lines 42 which extend diagonally through the palm portion 16 of the glove 10 whereby to further draw and gather glove material to enhance proper fit through the thumb and forefinger region by preventing the build-up of glove material or the possibility of material in the palm from moving, riding or lifting up which would otherwise interfere with the grip of the golfer relative to the golf club handle.

It will be seen that the unique force lines 42 generated by the golf glove 10 of the present invention result from the novel diagonal relationship of the elastic means 32, 34 and 36 and diagonal opening 22 along with diagonal Velcro fastening members 25 and 26 relative to the rest of the structure of the glove. For purposes of definition herein the term "diagonal" means an angle of approximately 45 degrees relative to the axis of the user's arm when the glove is worn. However, the term also includes variations of that angle of about + and −25 degrees whereby the term diagonal refers to an angular relationship relative to the user's arm in the range of 20 degrees to 70 degrees. A plurality of conventional air vent holes 23 may be employed preferrably along the finger stalls.

It will now be understood that what has been disclosed herein comprises a novel golf glove suitable for a variety of sporting events and comprising a hollow, flexible body provided with a unique diagonal opening for allowing easy access to the glove for repeated iterations of putting a glove on and taking a glove off during a day's play. In addition, the present comprises a novel diagonally shaped fastening means associated with the diagonal opening as well as a plurality of diagonally oriented elastic means positioned relative to the diagonal opening and the fastening members. This combination generates a diagonally oriented line of tension or force through the palm of the glove in addition to the conventional cross-directed lines of force or tension in the palm of the glove whereby to significantly reduce the possibility of glove material building-up in the palm area and otherwise interfering with the interaction of the golfer and the golf club.

As a result of the applicant's disclosure herein, those having skill in the art to which the present invention pertains will now perceive various modifications and additions which may be made to the present invention. By way of example, the precise number of elastic means and their precise location relative to the axis of the user's arm when the glove is worn may be varied while still achieving the easy opening feature and diagonal tension force feature of the present invention. Accordingly, all such modifications and additions are deemed to be within the scope of the invention which is to be limited only by the claims appended hereto.

I claim:

1. A sport glove of the type having a palm-side and a knuckle-side joined at a seam and defining a plurality of finger stalls, an access aperture adjacent a wrist-heel that is adapted to be substantially perpendicular to the wearer's arm and a fastenable opening extending from the access aperture toward the finger stalls for placing the glove on the hand and securing the glove thereon; the glove comprising:

first fastening means positioned on one side of said opening;

second fastening means positioned on another side of said opening opposite said first fastening means;

said opening and said first and second fastening means each extending diagonally along said knuckle-side whereby to provide easy access for placing the glove on the hand and removing the glove from the hand;

first elastic means extending between said opening and said seam in a direction substantially perpendicular to said opening, and second elastic means extending along the wrist-heel of said glove, at least one such first elastic means extending between said opening and said second elastic means and on each side of said seam whereby said first elastic means and said fastening means produce diagonally-directed tension forces through the palm area of said glove when said glove is worn on a wearer's hand.

2. The glove recited in claim 1 wherein said first and second fastening means comprise inter-lockable male and female mating loops, respectively.

3. A sport glove of the type having a palm-side and a knuckle-side joined at a seam and defining a plurality of finger stalls, an access aperture adjacent a wrist-heel that is adapted to be substantially perpendicular to the wearer's arm and a fastenable opening extending from the access aperture toward the finger stalls for placing the glove on the hand and securing the glove thereon; the glove comprising:

an elongated elastic material sewn into said glove between said opening and said wrist-heel and having an axis directed at an angle in the range of about 20 degrees to about 70 degrees relative to the axis of the arm of the wearer's hand, whereby to generate tension force in the palm area of said glove along said angularly directed axis, said elongated elastic material extending from said seam on both said palm-side and said knuckle-side of said glove;

said opening being defined by a diagonal edge that is substantially perpendicular to said elongated elastic material.

4. The glove recited in claim 3 further comprising contact fastening means having at least one edge that is parallel to and adjacent to said diagonal opening edge.

* * * * *